US007096655B2

(12) United States Patent
Tao et al.

(10) Patent No.: US 7,096,655 B2
(45) Date of Patent: Aug. 29, 2006

(54) METHOD AND APPARATUS FOR MANUFACTURING A SINGLES RING YARN

(75) Inventors: Xiaoming Tao, New Territories (HK); Bingang Xu, Kowloon (HK); Sing-Kee Wong, Kowloon (HK)

(73) Assignee: The Hong Kong Polytechnic University, Hong Kong (HK)

( * ) Notice: Subject to any disclaimer, the term of this patent is extended or adjusted under 35 U.S.C. 154(b) by 90 days.

(21) Appl. No.: 10/858,400

(22) Filed: Jun. 2, 2004

(65) Prior Publication Data

US 2005/0268591 A1 Dec. 8, 2005

(51) Int. Cl.
*D01H 7/52* (2006.01)

(52) U.S. Cl. ..... 57/75; 57/332

(58) Field of Classification Search ..... 57/75, 57/332–349

See application file for complete search history.

(56) References Cited

U.S. PATENT DOCUMENTS

| | | | | |
|---|---|---|---|---|
| 2,981,050 | A * | 4/1961 | Dewhirst | 57/75 |
| 4,287,713 | A | 9/1981 | Bromley et al. | 57/288 |
| 6,012,277 | A * | 1/2000 | Prins et al. | 57/315 |
| 2003/0200740 | A1 | 10/2003 | Tao et al. | 57/60 |

FOREIGN PATENT DOCUMENTS

| | | | |
|---|---|---|---|
| GB | 2011493 | A | 7/1979 |
| JP | 02221428 | A | 9/1990 |
| JP | 11012866 | A | 1/1999 |

OTHER PUBLICATIONS

Araujo et al, Textile Research Journal, pp. 350-356, Jun. 1989, Spirality of Knitted Fabrics Part II: The Effect of Yarn . . . .
Barella et al, Textile Research Journal, pp. 767-769, Oct. 30, 1988, Friction Spun Yarns Versus Ring and Rotor Spun Yarns . . . .
Lord et al, Textile Research Journal, pp. 405-414, Jun. 1974, The Performance of Open-End, Twistless, and Ring Yarns in . . . .
Sengupta et al, Textile Research Journal, pp. 692-694, Oct. 1984 Structure of Fiber Assembly During Yarn Formation in Rotor . . . .
Barella et al, Textile Research Journal, pp. 425-426, Jul. 1988 Predicting "Machine Twist" in Rotor Open-end Spun Cotton Yarns.

(Continued)

*Primary Examiner*—Shaun R Hurley
(74) *Attorney, Agent, or Firm*—Jacobson Holman PLLC

(57) ABSTRACT

In a process for manufacturing a singles ring yarn, firstly a first twist is supplied to a strand of traveling drafted fibers at a false twist device for producing a preliminary singles yarn. The false twist device rotates at a first speed for twisting the fibers. Immediately after the first twisting step, a joint twist of a second twist in the same direction as the first twist and a third twist in a reversed direction is supplied to the preliminary yarn for producing a final singles ring yarn. The second twist is produced by a rotatable take-up package onto which the final singles yarn is drawn. The reversed twist results in correspondence to the first twist, and the take-up package rotates at a second speed. The final singles yarn is then drawn onto the take-up package. Furthermore, a ratio of the first speed to the second speed is controlled for controlling the amount of a residual torque in the final singles ring yarn.

27 Claims, 8 Drawing Sheets

OTHER PUBLICATIONS

Lau et al, Textile Asia, pp. 95-102, Aug. 1995, Spirality in single-jersey fabrics.
Sawhney et al., Textile Research Journal, pp. 550-555, Sep. 1995 Tandem Spinning.
Sawhney et al, Textile Research Journal, pp. 21-25, Jan. 1992, Improved Method of Producing a Cotton Covered/Polyester . . . .
Tao et al, Textile Research Journal, vol. 67, No. 10, Oct. 1997, pp. 739-746, Torque-Balanced Singles Knitting Yarns Spun by . . . .

* cited by examiner

METHOD AND APPARATUS FOR MANUFACTURING A SINGLES RING YARN

BACKGROUND

1. Field of the Invention

The present invention relates generally to textile technologies, and more particularly to methods and apparatus for manufacturing singles ring yarns, whose residual torque can be controlled.

2. Background of the Invention

Twisting is an important step of short fiber spinning. In this process, the yarns, are elastically twisted and transformed to attain sufficient strength, wear resistance and smoothness. However, as a negative effect, a large amount of residual torque or twist liveliness is also brought about in the yarns simultaneously. Such twist liveliness of the yarns renders a significant influence on the possessing quality of the latter products. For example, if yarns with twist liveliness are used on knitting, loops of the fabric will lose their balance because of the variation of torsion stress in the yarns. In order to attain the natural structure with the minimum energy condition, the loops tend to rotate to release the internal torsion stress. As a result, one end of the loops will tilt and protrude from the fabric surface, while the other end will stay inside the fabric. Such deformation of the loops will increase the spirality of the fabric, i.e., a deformation similar to the rib effect, which should be prevented to the utmost in the spinning industry. Thus, the balancing of torque inside the yarns is particularly important.

Yarns are made from a large quantity of fibers polymerized by their friction in-between. Hence, the residual torque of the yarns or the spirality of the fabric is mainly affected by said characteristic of the fibers, such as the type and cross sectional shape of the fibers, the polymerizing manner of the fibers and the internal structure of the yarns, etc.

First of all, different types of fibers have a different modulus (i.e. tensile, bending and shear) and cross sectional shape, thus lead to different degree of stress in the yarns. According to the report of Arauj and Smith in the Textile Research Journal, Vol. 59, No. 6, 1989, in the cotton/polyester blended yarns, increasing the ratio of polyester will enhance the twist liveliness of rotor and ring yarns, thus improving the spirality of the yarns. This is because polyester has a higher modulus, and said two types of fiber have different cross sectional shapes.

Next, different yarn structures have a different distribution of stress. Experimental results, such as Barella and Manich in the Textile Research Journal, Vol. 59, No. 12, 1989, Lord and Mohamed in the Textile Research Journal, Vol. 44, No. 7, 1974 and Sengupta, and Sreenivasa in the Textile Research Journal, Vol. 64, No 10, 1994 show that, friction yarns (DREF-II) have the largest residual torque and trend of deformation in the priority sequence as ring yarns, rotor yarns and air-jet yarns. The different residual torques of said four types of yarn show the difference among their structures. It is generally agreed that single ring yarns are composed of a plurality of uniformly enveloped concentric helical threads, which fiber migration is a secondary feature. Hence, when the ring yarns are reverse-twisted, their strength will gradually decrease to zero, by then the yarns will be all dispersed. In relation to ring yarns, unconventional spinning systems produce yarns with core-sheath structures, such as rotor spinning yarn, air jet spinning yarn and friction spinning yarns. The packing density of said yarns is uneven, mainly characterized in the partial entanglement and enwrapment of the fibers. As a result, during reverse twisting, the strength of said yarns would not completely disappear, as disclosed in the Textile Research Journal, Vol. 58, No. 7, 1988 by Castro etc.

In addition, many factors can affect the degree of movement freedom of the loops of the fabric and also the final spirality of the fabric. Said factors include fabric structure, parameters of the knitting machine, and the fabric relaxation and fabric setting due to finishing. All the aforesaid factors affecting the spirality of fabric are reported in detail as disclosed by Lau and Tao in the Textile Asia, Vol. XXVI, No. 8, 1995.

Same as other materials, the residual torque of the yarns can be reduced or eliminated with different methods. In the past several decades, a variety of torque balancing methods have been developed. According to basic theory, they can generally be split into two categories: permanently processing methods and physical torque balancing methods.

Permanently processing methods mainly accomplish the purpose of releasing residual torque by transforming the elastic torsional deformation into plastic deformation. The method mainly relates to a variety of processing techniques for material, such as thermal processing, chemical processing and wet processing etc. In the Textile Research Journal, Vol. 59, No. 6, 1989, Araujo and Smith have proved that in relative to air-jet and rotor yarns, the heat processing of single cotton/polyester blended yarns can effectively reduce the residual torque of the yarn, However, in relation to natural fibers such as cotton or wool, permanent processing is too complicated. It may involve steam processing, hot water processing and chemical processing (such as mercerization in the case of cotton yarns and treatment with sodium bisulphite in case of the wool yarns). In addition, in relation to natural yarns, permanent processing cannot completely eliminate the residual torque of the single yarns, and it may cause damage and abruption to the yarns.

Compared with permanent processing, physical torque balancing is a pure mechanical processing technique. The main point of the method is fully utilizing the structure of yarns to balance the residual torque generated in different yarns while maintaining the elastic deformation characteristic of the yarns. Currently in the industry, separate machines are required to enforce torque balancing of the yarns hence the cost is higher. The method comprises plying two identical singles yarns with a twist equal in number but in the opposite direction to that in the singles yarns; or feeding two singles yarns with twist of the same magnitude but in opposite direction onto the same feeder.

Recently, some new torque balancing methods for yarns also emerged in the Textile Research Journal, Vol. 65, No. 9, 1995, Sawhney and Kimmel described a series spinning system for processing torque-free yarns. The inner core of said yarns is formed by processing with an airjet system while outside the core is enwrapped with crust fibers similar to DREF-III yarns. In the Textile Research Journal, Vol. 62, No. 1, 1992, Sawhey etc. have suggested a method of processing ring cotton crust/polyester inner core yarns Said yarns accomplish balancing condition by utilizing core yarns with opposite twisting direction from synthetic yarns, or applying heat processing on the polyester portion of said yarns. However, it is readily seen that the machines and processing techniques related to the aforesaid method are generally more complicated. In the Textile Research Journal, Vol, 57, No. 10, 1997, Tao has processed the layer structure of the inner core-crust of rotor yarns to generate torque-free single yarns, yet said technique is not suitable for ring yarns.

In addition, U.S. Patent Application No. 2003/0200740, filed by Xiaoming Tao et al. and entitled "Manufacturing Method and Apparatus for Torque-Free Singles Ring Spun Yarns," discloses a method of producing torque-free singles ring yarns. According to this patent application, a draft fiber is divided into a plurality of sub-assemblies of fibers. Each sub-assembly of fibers firstly attains an individual twist value during a false twisting, and then are twisted together to form the final yarns. The false twisting is controlled such that balance of the internal torque of the final yarns is achieved.

The above-mentioned patent application merely teaches how to produce torque-free singles ring yarns. However, in some circumstances, the customer may want to retain in the final yarns a controllable amount of residue torques for various reasons, one of which can be, for example, for the strength of the final yarns. Furthermore, the abovementioned patent application is more appropriate for torque-free singles ring yarn production in the laboratory scale and may not be able to meet the practical requirements of the large-scale production in the textile industry.

OBJECT OF THE INVENTION

Therefore, it is an object of the present invention to provide an improved method and apparatus for manufacturing singles ring yarns in the textile industry more practically, where the residual torque of the yarns can be controlled, or at least provide the public with a useful choice.

SUMMARY OF THE INVENTION

According to an aspect of present invention, a process for manufacturing a singles ring yarn includes:

- supplying a first twist to a strand of traveling drafted fibers at a false twist device for producing a preliminary singles yarn, wherein the false twist device rotates at a first speed for twisting the fibers;
- immediately after the first twisting step, supplying to the preliminary singles yarn a joint twist of a second twist in the same direction as the first twist and a third twist in a reversed direction for producing a final singles ring yarn, wherein the second twist is produced by a rotatable take-up package onto which the final singles yarn is drawn, wherein the reversed twist results in correspondence to the first twist, and wherein the take-up package rotates at a second speed;
- drawing the final singles yarn onto the take-up package; and
- controlling a ratio of the first speed to the second speed for controlling the amount of a residual torque in the final singles ring yarn.

According to another aspect of the present invention, an apparatus for manufacturing a singles ring yarn includes:

- a false twist device rotating at a first speed for supplying a first twist to a strand of traveling drafted fibers such that a preliminary singles yarn is produced; and
- a take-up package rotating at a second speed for supplying a second twist in the same direction as the first twist to the preliminary singles yarn,
- wherein the manufactured singles ring yarn is to be drawn onto the take-up package, wherein a joint twist of the second twist and a third twist in a reversed direction are supplied to the preliminary singles yarn for producing a final singles ring yarn, wherein the reversed twist results in correspondence to the first twist, and wherein a ratio of the first speed to the second speed is controllable such that the amount of a residual torque in the final singles ring yarn can be controlled.

Other aspects and advantages of the invention will become apparent from the following detailed description, taken in conjunction with the accompanying drawings, which description illustrates by way of example the principles of the invention.

DETAILED DESCRIPTION

Figure 1:
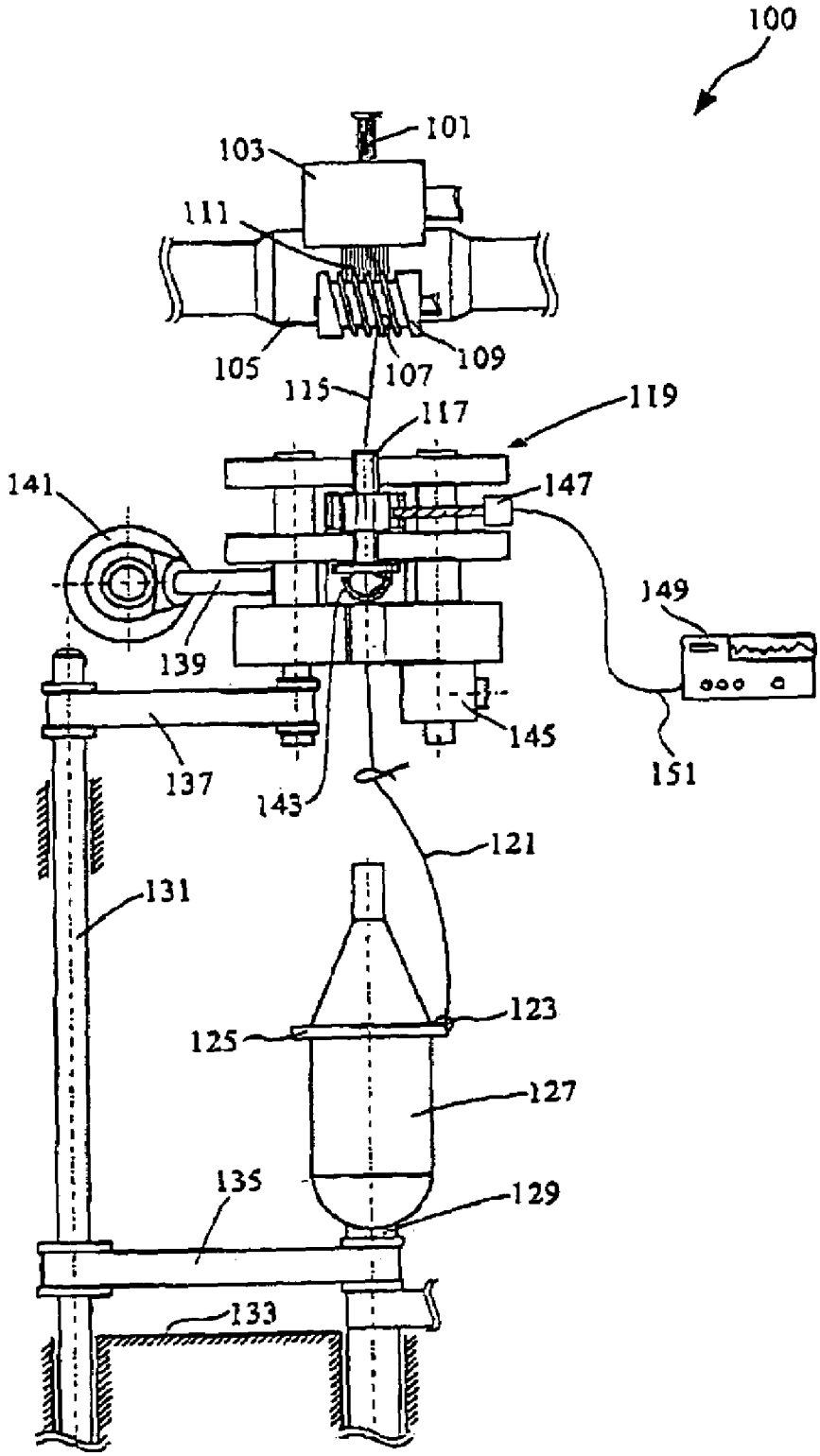
FIG. 1 is a diagrammatic plan view of a spinning apparatus in accordance with an exemplary embodiment of the present invention.

As shown in FIG. 1, in an exemplary spinning apparatus embodiment 100 of the present invention, a roving 101 is delivered by a front pair of top and bottom drafting rollers 103, 105 to enter a plurality of uniform or non-uniform grooves 107 distributed circumferentially on a rotating fiber separation roller 109 mounted in contact with and driven by the bottom front roller 105 in the form of a stand of drafted fibers 111. The separation roller 109 splits the strand of drafted fibers into a plurality of sub-assemblies of fibers 701 (see FIG. 7), and each of the resulting sub-assemblies 701 (see FIG. 7) of fibers in these grooves 107 is twisted individually before they are twisted together or synthesized to form a preliminary singles yarn 115 by the torque generated by the rotating actions of a false twist head 117 set on a false twist device 119. This twist is identified as a false twist in this application.

Immediately after the preliminary singles yarn 115 has passed through the false twist device 119, a joint twist of a true twist in the same direction as the false twist and a reverse twist in response to the false twist is supplied to the preliminary singles yarn 115 for producing a final singles ring yarn 121. Thereafter, the final singles yarn 121 passes through a traveler 123 on a ring rail 125 and is then drawn onto a take-up package 127 centered on a rotating ring spindle 129. The ring rail 125 circles the take-up package and moves upward and downward along the take-up package in operation.

In the exemplary embodiment, the reverse twist arises as an automatic result accompanying the false twist, which is caused by the rotating false twist head 117 located on a traveling path of the yarn between the separation roller 109 and the take-up package 127; the true twist is caused by the rotating take-up package. In addition, the false twist head 117 rotates at a relatively high speed about 4–6 times of the rotational speed of the ring spindle 129. Therefore, during production of the preliminary yarn 115, it is the false twist provided by the false twist head 117 that is mainly exerted on the stand of fibers 111.

Furthermore, in the exemplary embodiment, the residual torque within the final singles ring yarn 121 is controlled by controlling a ratio of the false twist head's rotational speed to the take-up package's rotational speed. In specific, a driving system 131 is installed on a ring frame 133 of the spinning apparatus 100 and serves to transmit rotational powers from the rotating ring spindle 129 to the false twist device 119. The driving system 131 is driven by the rotating spindle 129 through a belt 135 and further drives the false twist device 119 to rotate via another belt 137 with a controllable transmission ratio predetermined by the desired balancing level of the residual torque within the final singles ring yarn 121.

In addition, a sucker 139, with its one end inserted in a two-sucker connector 141 and the other end facing and in close proximity to a semi-ring 143 of the false twist head 117, is used to clean fly for better control of yarn qualities at the false twist device 119; a speed reducer 145, installed on the false twist device 119, is to control the rotational speed of the false twist device 119 at certain circumstances for easy yarn threading up, piecing and doffing operations; an inductive displacement sensor 147 connected to its integrated amplifier 149 via a wire 151 monitors the vibration amplitude of the false twist head 117 for better control of yarn qualities, which may be affected by the oscillation of the false twist head 117 when the false twist head 117 rotates at a high speed.

Figure 2:
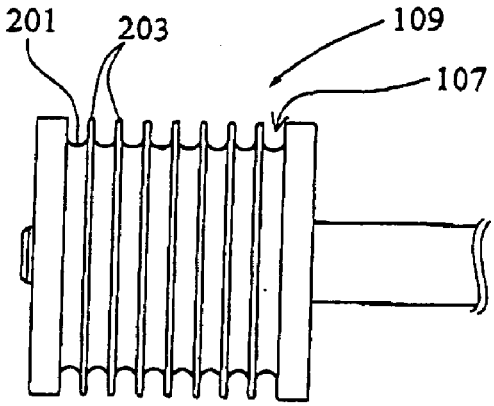
FIG. 2 is a plan view of a fiber separation roller, which is part of the spinning apparatus embodiment of FIG. 1.

With reference to FIG. 1, FIG. 2 illustrates that the fiber separation roller 109 is mounted in contact with the bottom front roller 105 and is driven to rotate at the same linear velocity as the one of the bottom front roller 105. A plurality of continuous grooves 107 is distributed annularly on the circumferential surface of the fiber separation roller 109 for continuously dividing the strand of drafted fibers 111 into a plurality of fiber sub-assemblies 701. The configuration of these grooves 107 on the fiber separation roller 109 is particularly important for the separation results of the strand of drafted fibers 111 as well as the individual twist of the sub-assemblies 701 afterwards. In the exemplary embodiment, the bottom 201 of the grooves is in an arc shape, which may benefit the individual twist of the sub-assemblies of the fibers 701. In addition, the width of groove is designed to be much larger than that of the extrusive land 203 between two adjacent grooves, and the shape of the extrusive land 203 is also configured in an arc shape. These designs assist the strand of drafted fibers 111 to be separated into the grooves 107 as much and as smooth as possible.

Figure 3:
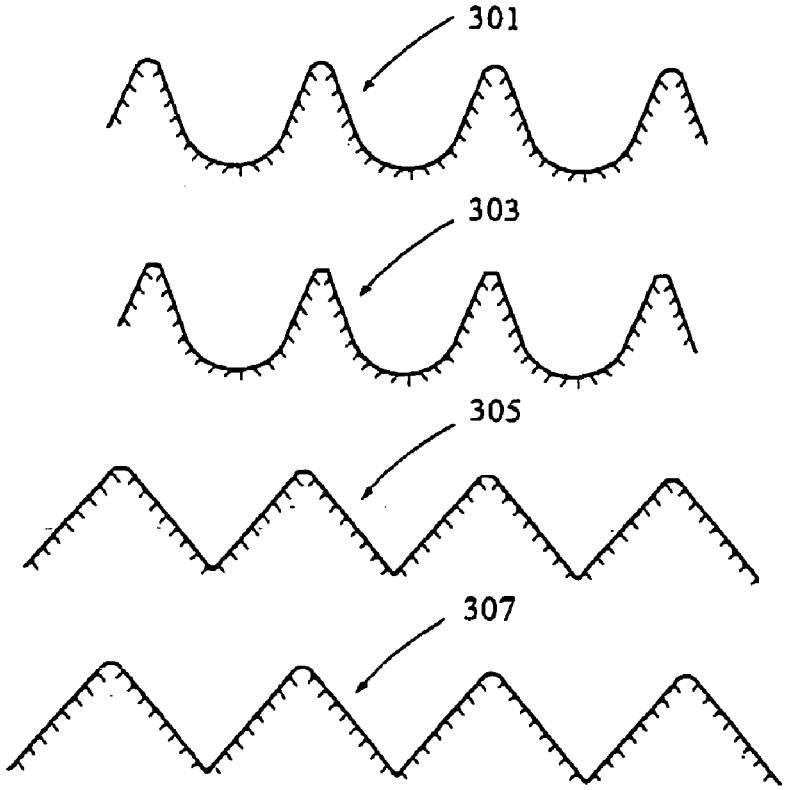
FIG. 3 illustrates four alternatives of a uniform groove shape of the fiber separation roller of FIG. 2.

FIG. 3 illustrates four alternatives of uniform groove shapes for the fiber separation roller 109, in the form of four enlarged axially cross-sectional views of the fiber separation roller 109. The most desirable groove shape is indicated by the cross-sectional configuration 301 in which both the bottom shape of groove and the extrusive land shape are arcs with the connection line tangent to both of them. The cross-sectional configuration 303 is a second alternative configuration 301, where the extrusive land has a line shape stead of the arc figuration for more convenient manufacture purposes. Grooves illustrated by the cross-sectional configurations 305 and 307 are another two alternatives with their bottom configurations as a tapered shape. All these four types of groove shapes can be used for the fiber separation purpose, and which one is to be used mainly depends on the required separation effects and manufacture capabilities.

Figure 4:
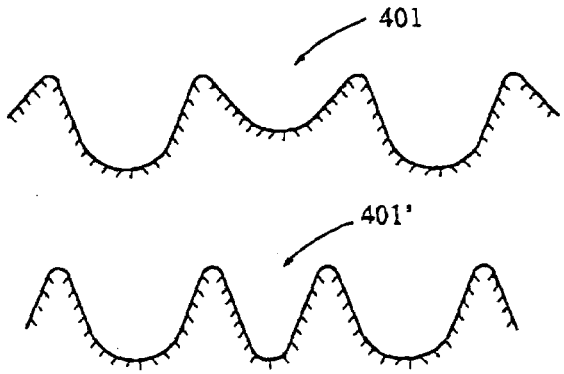
FIG. 4 illustrates two alternatives of a non-uniform groove shape of the fiber separation roller shown in FIG. 2.

FIG. 4 illustrates two alternatives of non-uniform groove shapes for the fiber separation roller 109, in the form of four enlarged axially cross-sectional views of the fiber separation roller 109. The non-uniformity of groove shapes can be achieved by various ways. In the cross-sectional configuration 401, two types of groove shapes of different depth are either alternately or not cut on the separation roller. The cross-sectional configuration 401' is an alternative of configuration 401, wherein two types of grooves of different width are either alternately or not appear on the separation roller.

Figure 5A:
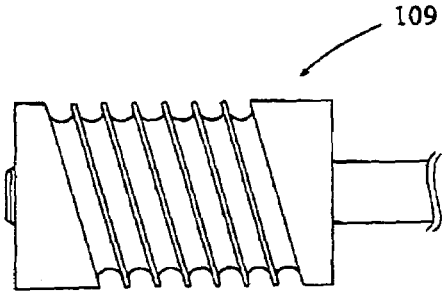
FIGS. 5A and 5B illustrate two alternatives of the distribution form of grooves on the surface of the fiber separation roller of FIG. 2.
Figure 5B:
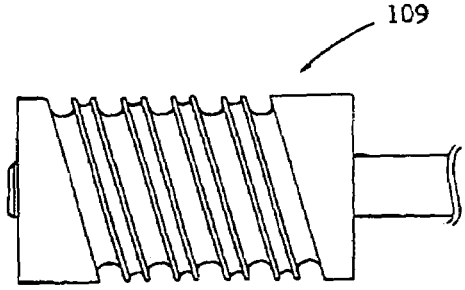

FIGS. 5A and 5B show two alternatives of the distribution form of grooves on the fiber separation roller 109. FIG. 5A provides the fiber separation roller 109 with an "S" spirally distributed groove instead of the annularly distributed grooves shown in FIG. 2. FIG. 5B provides another fiber separation roller 109 with two "S" spirally distributed grooves of different depths and widths, which illustrates application of non-uniform groove shape of FIG. 4 to the fiber separation roller 109.

In summary, FIGS. 2–5 provide independently various groove shapes and types which can be further cross-combined to form various types of fiber separation roller to meet different flexible and controllable fiber separation requirements.

Figure 6:
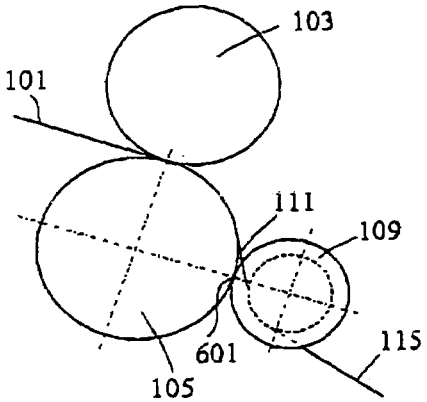
FIG. 6 is a side enlargement of part of FIG. 1, showing the installation position of the fiber separation roller of FIG. 2.
Figure 7:
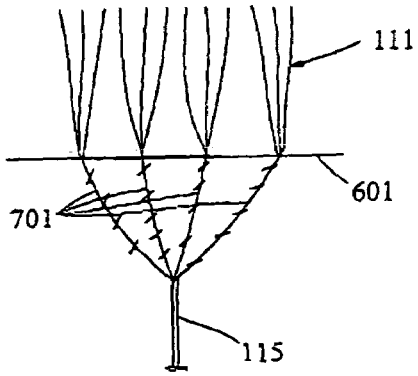
FIG. 7 illustrates in plan a strand of traveling drafted fibers, a contact nip between the front drafting roller and the fiber separation roller, the twisted sub-assemblies of fibers and the final singles yarn of FIG. 1.

In FIGS. 6 and 7, the fiber separation roller 109 is mounted in contact with and driven to rotate by the bottom front roller 105. The contact therebetween defines a contact nip 601 between the fiber separation roller 109 and the bottom front roller 105. The moving roving 101 is drafted by the top roller 103 and the bottom roller 105, then is fed to travel along the bottom front roller 105, and further evenly or unevenly falls into the grooves 107 of the fiber separation roller 109 at the contact nip 601 in the form of a drafted stand of fibers 111. After that, the resulting sub-assemblies of fibers 701 in the grooves are firstly individually twisted simultaneously and then synthesized or twisted together to form the preliminary singles yarn 115 by the torque produced by and propagated from the false twist device 119.

Figure 8A:
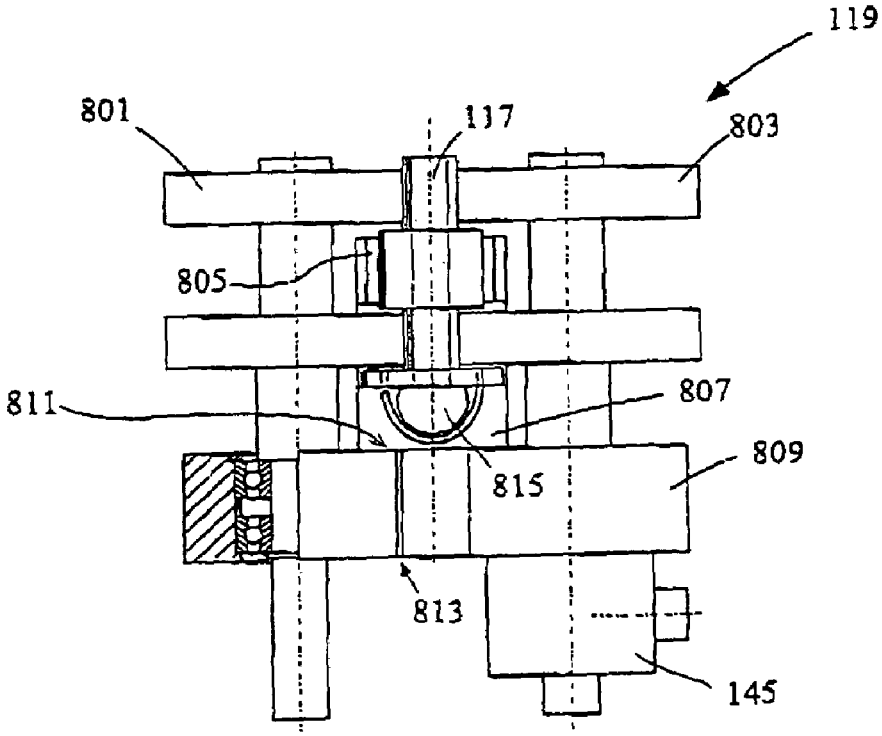
FIG. 8 illustrates diagrammatically front and top views of a mechanical false twist device, which is part of the spinning apparatus embodiment of FIG. 1.
Figure 8B:
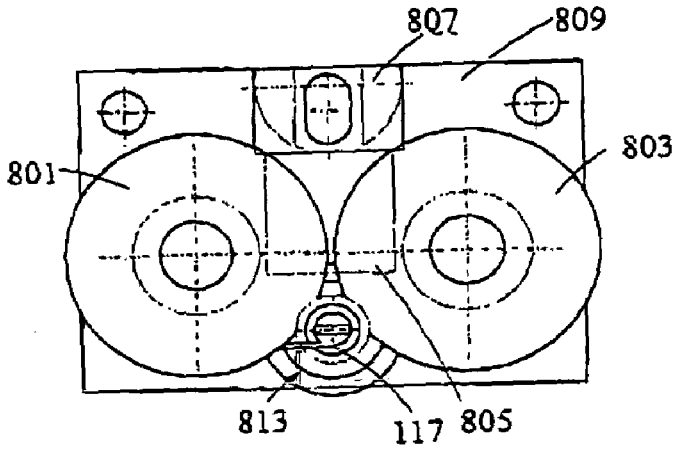

In FIG. 8, the false twist device 119 firstly includes a driving rotor 801, a driven rotor 803, a magnet 805 and a bracket 807 secured on a bed frame 809. Under the intensive sorption of the magnet 805, the false twist head 117 is in close contact with the driving rotor 801 and the driven rotor 803. The driving rotor 801 is driven to rotate by the torsional torque from the driving system 131 mounted on the ring frame 133, part of the torsional moment is transmitted to the false twist head 117 by the friction force on the contact surface between the driving rotor 801 and the false twist head 117, and further the twist head 117 forces the driven rotor 803 to rotate by a similar friction force on their contact surface. The preliminary singles yarn 115 enters the false twist device 119 at the top entrance of false twist head 117, then passes through its internal traveling hollow, further circles one or two loops around its bottom semi-ring 143, and finally passes through a guide hole 811 on the bed frame 809. The guide hole 811 is notched with a leading line 813 tangent to its internal hole with the width equal to or slightly larger than the diameter of the preliminary yarn 115. The leading line 813 can lead to an easy yarn threading up and piecing operation without the yarn running out from the hole during spinning. A hole 815, drilled on the bracket 807 of the false twist device 119 with its diameter slightly larger than that of the sucker 139, is used as a guide hold for the sucker 139, which is in close proximity to the semi-ring 143 of the false twist head 117 for cleaning fly and for better control of yarn qualities.

Figure 9:
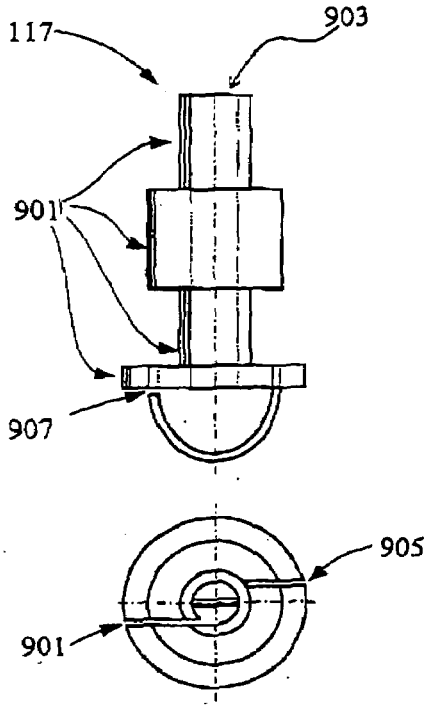
FIG. 9 illustrates diagrammatically front and top views of a false twist head with two notched lines, as an enlarged part of FIG. 8.

In FIG. 9, the false twist head 117 has one axially notched leading line 901, which is tangent to its internal yarn traveling hole 903 with the width equal to or slightly larger than the diameter of the preliminary yarn. Owing to the special design of the notched leading line 901, the yarn can be easily pieced-up for more practical usage without yarn running out from the hole during spinning. Another axially symmetrical notched line 905 is designed to balance the imbalance of the false twist head 117 introduced by the leading notched line 901 during its high-speed rotation. Moreover, one side of the bottom semi-ring 143 of the false twist head 117 is partially cut off to leave a leading room 907 for the easy piecing-up purpose.

Figure 10:
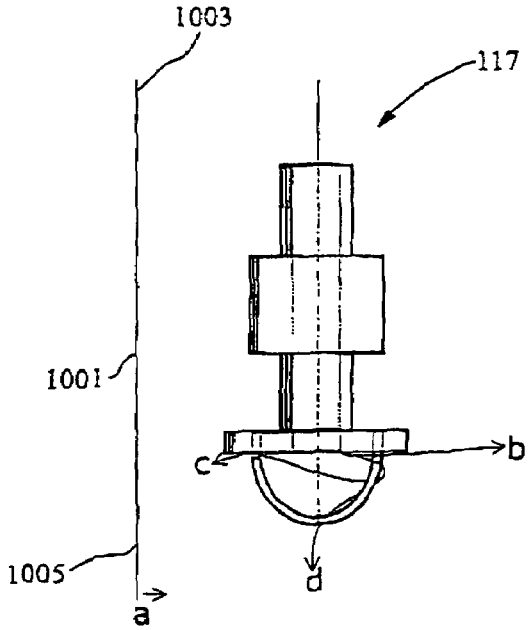
FIG. 10 illustrates diagrammatically a piecing-up procedure of yarn on the false twist head of FIG. 9.

In FIG. 10, the piecing-up procedure of a yarn on the false twist head 117 is diagrammatically decomposed into four stages represented by a to d respectively. In the original stage a, a leading yarn 1001 is straightly stretched and entirely put into the internal hole 903 of the false twist head 117 through the leading notched line 901. Then the top trail 1003 of the leading yarn 1001 is held on, while its bottom section 1005 is put out in the front of the semi-ring 143 and is ready to turn back around it as represented by the stage b. Further the leading yarn 1001 turns back around the semi-ring 143 until it reaches the leading room 907 as shown by the stage c. Finally the leading yarn 1001 passes through the leading room 907 to the front of the false twist head 117 and is stretched to be straight as shown in the stage of d, which ends one circle loop of the leading yarn 1001 on the false twist head 117. If two loops are required, stages b–d are simply repeated.

Figure 11:
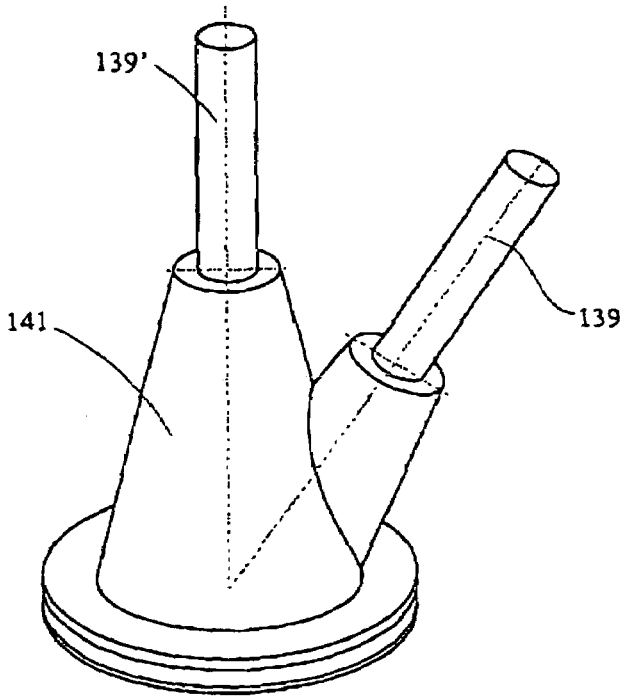
FIG. 11 is a diagrammatical view of a two-sucker connector with two suckers partially inserted, which can be used in the spinning apparatus embodiment of FIG. 1.

In FIG. 11, two suckers 139 and 139' are partially inserted into the two-sucker connector 141 installed on the ring spinning apparatus 100. One sucker 139' works as a conventional suction means for the drafted roving fibers at the top roller, whereas the other sucker 139, with its one end inserted into the two-sucker connector 141 and the other end facing and in close proximity to the semi-ring 143 of the false twist head 117, is used for cleaning fly and better control of yarn qualities at the location of the false twist device 119.

Figure 12A:
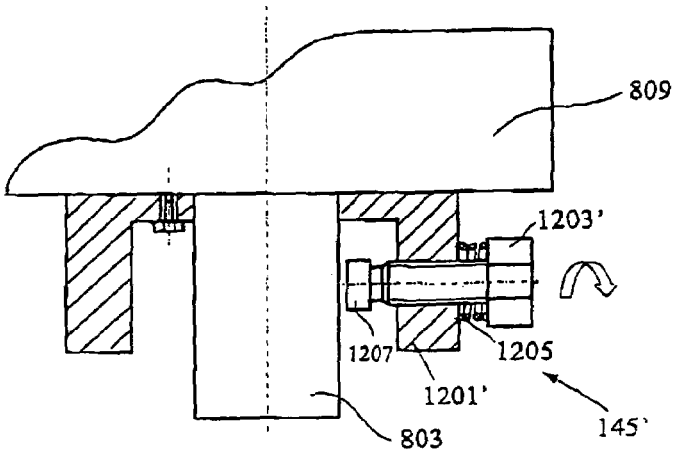
FIGS. 12A–12C illustrate diagrammatically cross-sectional views of three alternatives of a speed reducer for the false twist device of FIG. 8.
Figure 12B:
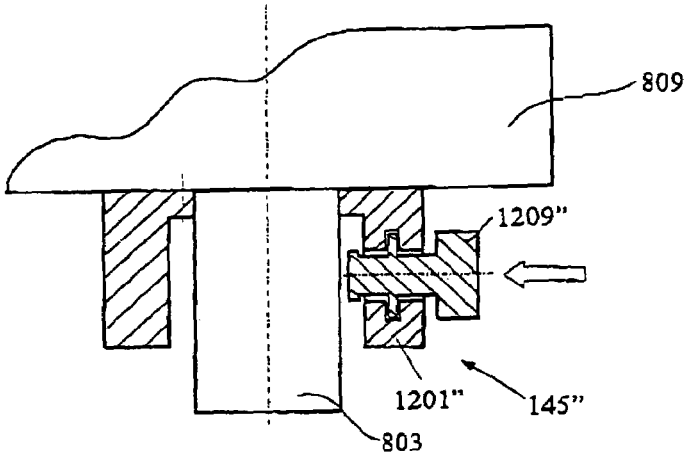
Figure 12C:
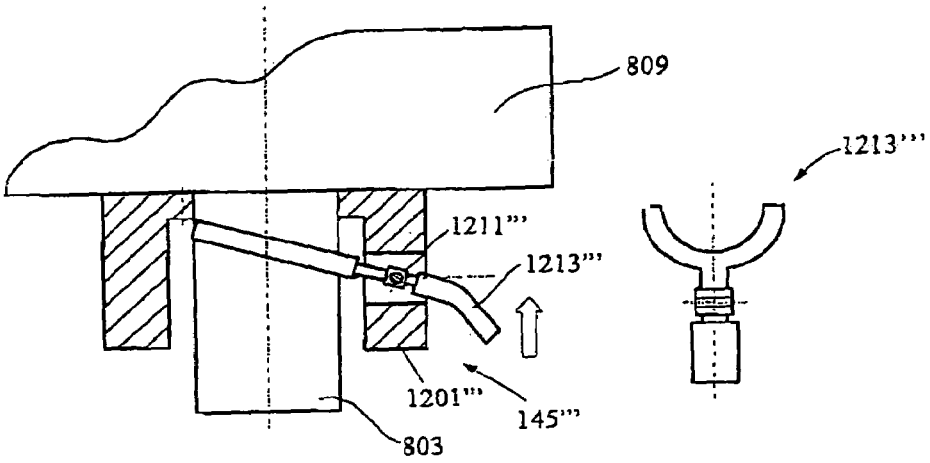

FIGS. 12A–12C diagrammatically illustrate three alternatives of the speed reducer 145 for the false twist device 119 in cross-sectional views. The function of the speed reducer is to control the rotational speed of the false twist device 119 at certain circumstances for easy yarn threading-up, piecing and doffing operations by adjusting the friction force between the driven rotor 803 and the speed reducer 145. In FIG. 12A, the speed reducer 145' includes a cylinder base 1201, a pulsive screw 1203, a stabilized-spring 1205 and a wearable reducer head 1207. Turning the pulsive screw 1203 in different directions, which has a screw-thread fit with the cylinder base 1201, can lead to the variation of friction force between the reducer head 1207 and the driven rotor 803 mounted on the bed frame 809. The speed reducer 145" shown in FIG. 12B includes the cylinder base 1201 and a deformable but wearable reducer head 1209. By pushing the reducer head 1209 forward under different amounts of forces, the friction force between the driven rotor 803 and the reducer head 1209 can be controlled. In FIG. 12C, the speed reducer 145'" includes the cylinder base 1201, a fastness pin 1211 and a wearable arc-shaped reducer head 1213. The reducer head 1213 is connected with the pin 1211 mounted on the cylinder base 1201 such that it can rotate around the pin 1211. By pushing the outside end of the reducer head 1213 up under different amounts of forces, the friction force between the reducer head 1213 and the driven rotor 803 could be adjusted.

Figure 13:
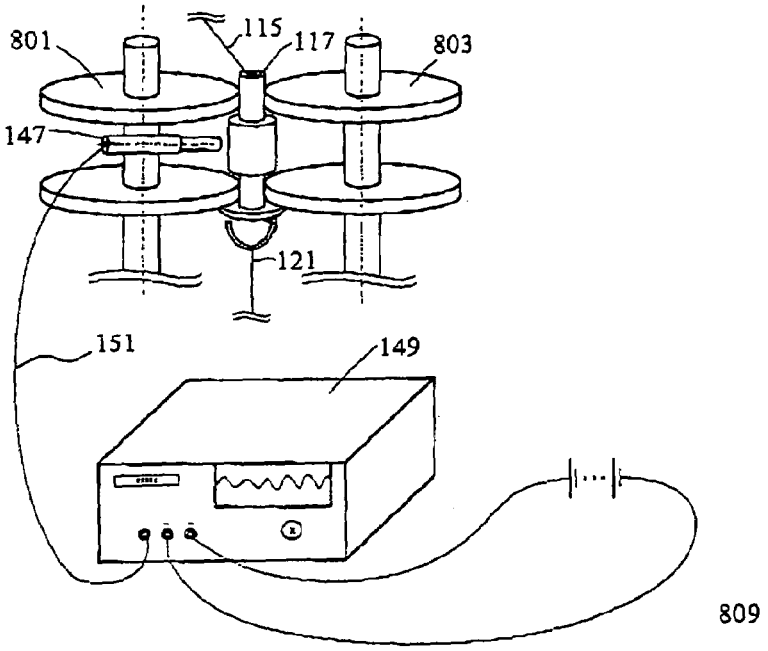
FIG. 13 illustrates diagrammatically a sensor monitoring system for monitoring vibration surveillance of the false twist head of FIG. 9.

In FIG. 13, an inductive displacement sensor 147 connected to its integrated amplifier 149 via a wire 151 monitors the vibration amplitude of the false twist head 117 so as to better control the quality of the singles yarns 115 and 121. The sensor 147 can be mounted to the bed frame 809 (not shown in FIG. 13) and ascertains the oscillation of the false twist head 117 during its high-speed rotation. In the exemplary embodiment, an acceptable upper-limit of the vibration value is pre-set. Thereby, yarn qualities can be automatically monitored by comparing the upper-limit value with the real-time vibration amplitude of the false twist head 117, which is indicated in the form of digitalis or curves on the panel of the integrated amplifier 149.

Figure 14:
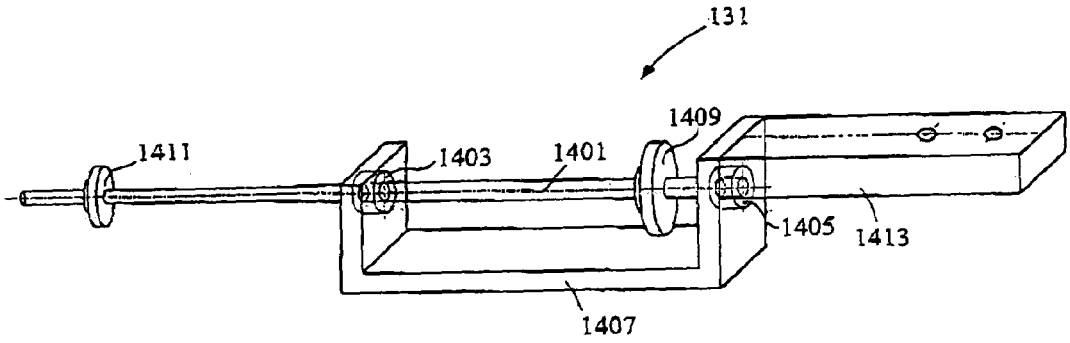
FIG. 14 is a diagrammatic view of a driving system with a particular tapered shaft, which is part of the spinning apparatus embodiment of FIG. 1.

In FIG. 14, a shaft 1401 is mounted on two sets of bearings 1403 and 1405. The shaft 1401 is designed in a tapered shape to meet the installation space limitation of the spinning apparatus without losing its running stability. An arch frame 1407 provides a suitable span for the coaxial sets of bearings of 1403 and 1405 and also contributes to the stability of the rotating tapered shaft 1401. Two sets of transmission disks 1409 and 1411 are set on the taper shaft 1401 for connecting with the ring spindle 129 and the false twist device 119 via the belts respectively. A connecter frame 1413 is designed for the installation of the driving system 131 on the ring frame 133.

Figure 15:
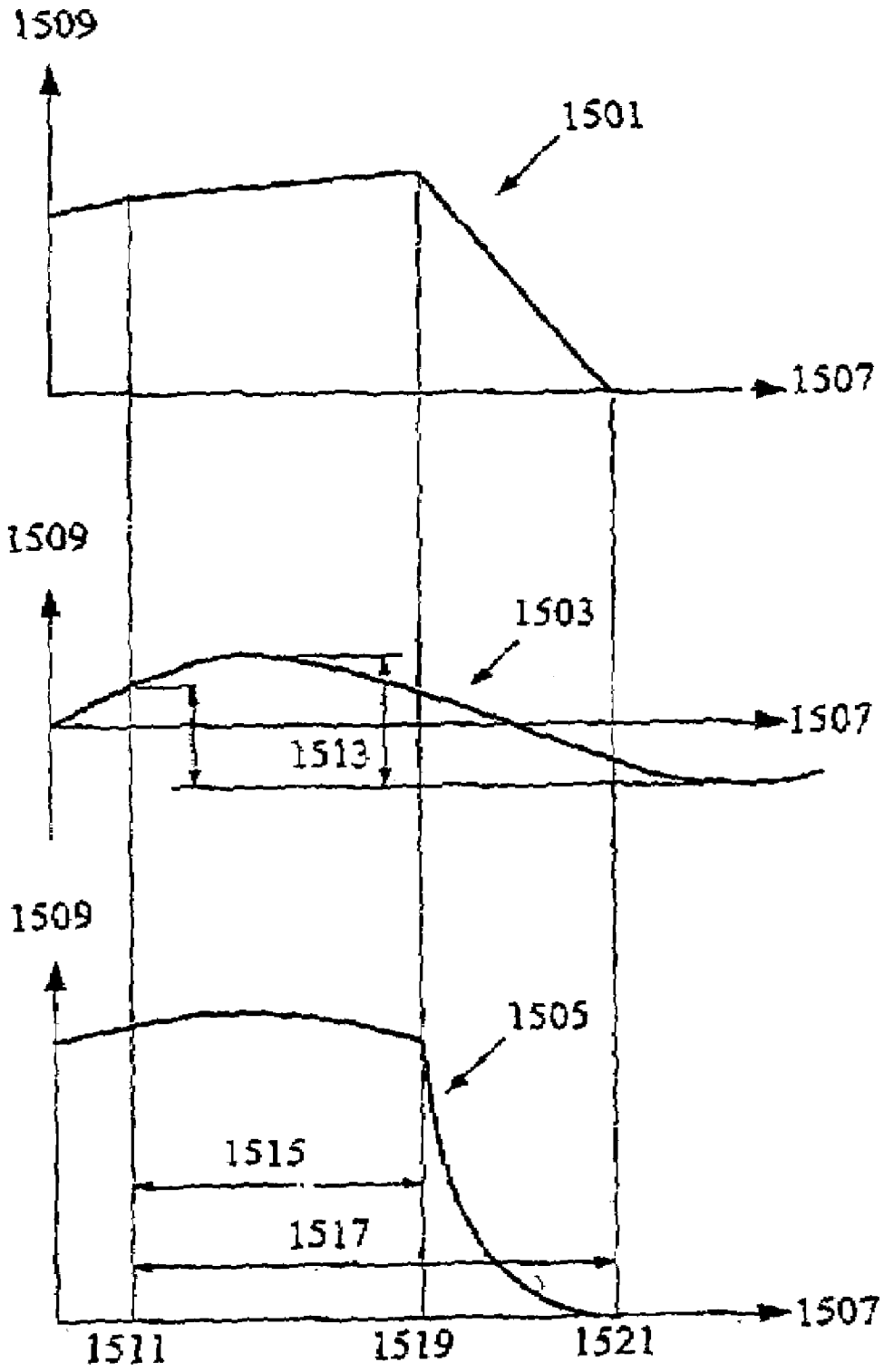
FIG. 15 is a diagrammatic view of the modified curves of vertical positions relative to time of a ring for yarn doffing operation.

Doffing process is now described with reference to FIG. 15. It is generally understood that the ring rail 125 is used to guide the drawing of the final singles yarn onto the take-up package. During the drawing, the ring rail 125 moves upwards to a plurality of mean positions and oscillates about each mean position between a peak upper position and a peak lower position for drawing the yarn onto the take-up package evenly. Conventionally, the spinning apparatus is powered off as soon as the ring rail has reached an up-most mean position. However, in the apparatus described above, the yarn may snap in such a conventional doffing process. The following modifications are therefore proposed. In FIG. 15, 1501, 1503 and 1505 are respectively the modified curves of the mean vertical position, oscillatory vertical position and the resultant vertical position of the ring rail. Two axes of the coordinates respectively represent time 1507 and vertical position 1509. According to an exemplary embodiment of the present invention, the spinning apparatus is powered off at time 1511 when the ring rail moves upwards during its oscillatory movements about the up-most mean position. Furthermore, the timing is selected when the ring rail has moved approximately two thirds of its peak-to-peak value 1513 from its peak lower position towards the peak upper position during its oscillation about the up-most mean position. Thereafter, it is waited for a predetermined period of time 1515, preferably approximately half of the total stop period of time 1517. Then the ring rail is finally pulled down the ring gradually at the winding time 1519 until the ring completely stops at the termination time 1521.

Alternatives can be made to the exemplary embodiment. For example, the false twist head 117 and the take-up package can be driven be separate motors. Therefore, control of the ratios of the rotational speeds is done by respective control of the motors, rather than through the driving device 131.

What is claimed is:

1. A process for manufacturing a singles ring yarn, comprising:

supplying a first twist to a strand of traveling drafted fibers at a false twist device for producing a preliminary singles yarn, wherein the false twist device rotates at a first speed for twisting the fibers;

immediately after the first twisting step, supplying to the preliminary singles yarn a joint twist of a second twist in the same direction as the first twist and a third twist in a reversed direction for producing a final singles ring yarn, wherein the second twist is produced by a rotatable take-up package into which the final singles yarn is drawn, wherein the reversed twist results in correspondence to the first twist, and wherein the take-up package rotates at a second speed;

drawing the final singles yarn into the take-up package; and controlling a ratio of the first speed to the second speed for controlling the amount of a residual torque in the final singles ring yarn.

2. The process of claim 1, wherein the step of supplying the first twist includes prior to supplying the first twist, splitting the strand of traveling drafted fibers into a plurality of sub-assemblies of fibers by a fiber separation roller.

3. The process of claim 2, wherein the step of supplying the first twist further includes selecting whether or not to split the strand of traveling drafted fibers into the sub-assemblies of fibers depending on a property of the strand of fibers.

4. The process of claim 2, wherein the step of supplying the first twist further includes after the splitting, firstly individually twisting each sub-assembly of fibers; and synthesizing the sub-assemblies of the fibers into the preliminary singles yarn.

5. The process of claim 2, wherein both the preliminary singles yarn and the sub-assemblies are reversely twisted in the step of supplying the joint twist for producing a yarn structure in which the sum of residual torques generated by the sub-assemblies may counteract the residual torque of the resultant singles yarn to various extents.

6. A process for manufacturing a singles ring yarn, comprising:

supplying a first twist to a strand of traveling drafted fibers at a false twist device for producing a preliminary singles yarn, wherein the false twist device rotates at a first speed for twisting the fibers:

immediately after the first twisting step, supplying to the preliminary singles yarn a joint twist of a second twist in the same direction as the first twist and a third twist in a reversed direction for producing a final singles ring yarn, wherein the second twist is produced by a rotatable take-up package into which the final singles yarn is drawn, wherein the reversed twist results in correspondence to the first twist, and wherein the take-up package rotates at a second speed;

drawing the final singles yarn into the take-un package;

controlling a ratio of the first speed to the second speed for controlling the amount of a residual torque in the final singles ring yarn; and driving a driving system to rotate by a rotating ring spindle, on which the take-up package is centered, transmitting rotational forces from the ring spindle to the false twist device, and wherein the driving system has a controllable transmission ratio depending upon a desired residual torque in the final singles ring yarn.

7. The process of claim 1, further comprising monitoring a vibration factor of the false twist device for controlling quality of the final singles ring yarn.

8. The process of claim 1, further comprising absorbing fly at the false twist deice for controlling quality of the final singles ring yarn.

9. The process of claim 1, wherein the process is implemented in a spinning machine, and wherein the machine includes a ring rail circling the take-up package for guiding the drawing of the final singles yarn onto the take-up package, wherein the ring rail generally moves upwards to a plurality of mean positions and oscillates about each mean position between a peak upper position and a peak lower position during the drawing of the yarn, the process further comprising during a doffing process when the ring rail has reached its uppermost mean position and oscillates about the uppermost mean position, shutting off power of the machine at a predetermined time when the ring rail moves upwards during its oscillatory movements about the uppermost mean position;

waiting for a predetermined period; and after waiting for the period, moving the ring rail downwards gradually until the machine stops completely.

10. The process of claim 9, wherein the step of shutting off the power includes shutting off the power when the ring rail has moved upwards approximately two thirds of the distance between the peak upper position and the peak lower position relating to the uppermost mean position.

11. The process of claim 9, wherein the predetermined period is approximately half of a total period of time for the machine to stop.

12. An apparatus for manufacturing a singles ring yarn, comprising:

a false twist device rotating at a first speed for supplying a first twist to a strand of traveling drafted fibers such that at a preliminary singles yarn is produced; and a take-up package rotating at a second speed for supplying a second twist in the same direction as the first twist to the preliminary singles yarn, wherein the manufactured singles ring yarn is to be drawn onto the take-up package, wherein a joint twist of the second twist and a third twist in a reversed direction are supplied to the preliminary singles yarn for producing a final singles ring yarn, wherein the reversed twist results in correspondence to the first twist, and wherein a ratio of the first speed to the second speed is controllable such that the amount of a residual torque in the final singles ring yarn can be controlled.

13. The apparatus of claim 12, further comprising a fiber separation roller located in front of the false twist device on a traveling path along which the strands of fibers travels for splitting the strand of traveling drafted fibers into a plurality of sub-assemblies of fibers.

14. The apparatus of claim 13, wherein the splitter has at least one spirally continuous distributed grooves on a surface.

15. The apparatus of claim 14, wherein a bottom shape of the groove is in an arc configuration.

16. The apparatus of claim 14, wherein a shape of the groove distributed on the splitter is uniform.

17. The apparatus of claim 12, wherein the false twist device includes a false twist head for assisting twist insertion.

18. The apparatus of claim 17, wherein the false twist head includes an internal yarn traveling hole with an a width at least approximately equal to the diameter of the preliminary singles yarn and a first axially notched leading line tangent to the internal yarn traveling hole for assisting yarn threading-up operations.

19. The apparatus of claim 18, wherein the false twist head includes a second axially notched line symmetrical to the first leading line for balancing the false twist head.

20. The apparatus of claim 17, wherein the false twist device includes a semi-ring located at the bottom of said false twist head, wherein the semi-ring is partially cut off to leave a leading room for assisting threading-up of the preliminary singles yarn.

21. The apparatus of claim 12, further comprising a sucker in close proximity to the false twist device for cleaning fly.

22. The apparatus of claim 12, further comprising a speed reducer installed on the false twist device to control the first speed for easy yarn piecing and doffing.

23. The apparatus of claim 12, further comprising a sensor installed on the false twist device for monitoring vibration surveillance of the false twist head.

24. An apparatus for manufacturing a singles ring yarn, comprising:

a false twist device rotating at a first speed for supplying a first twist to a strand of traveling drafted fibers such that at a preliminary singles yarn is produced;

a take-up package rotating at a second speed for supplying a second twist in the same direction as the first twist to the preliminary singles yarn, wherein the manufactured singles ring yarn is to be drawn onto the take-un package, wherein a joint twist of the second twist and a third twist in a reversed direction are supplied to the preliminary singles yarn for producing a final singles ring yarn, wherein the reversed twist results in correspondence to the first twist, and wherein a ratio of the first speed to the second speed is controllable such that the amount of a residual torque in the final singles ring yarn can be controlled; and a driving system for transmitting rotational forces from a rotating ring spindle, on which the take-up package is centered, to the false twist device, wherein the driving system has a controllable transmission ratio depending upon a desired residual torque in the final singles ring yarn.

25. The apparatus according to claim 24, wherein the driving mechanism includes a shaft designed in a tapered shape with a suitable span for meeting space limitation of the apparatus while simultaneously at least maintaining its rotating stability.

26. The process of claim 1, further comprising piecing-up a yarn on a false twist head by the following steps:

stretching a yarn straightly and putting the yarn into an internal hole of the false twist head through a leading notched line;

holding on a top trail of the yarn, while its bottom section is put out in the front of a semi-ring of the false twist head and is ready to turn back around it;

turning the yarn back around the semi-ring until it reaches a leading room of the twist false head; and passing the yarn through the leading room to the front of the false twist head and stretching the yarn straight, which ends one circle loop of the yarn on the false twist head.

27. The apparatus of claim 17, further comprising two suckers installed on a sucker connector, with one sucker facing and being in close proximity to a semi-ring of the false twist head for cleaning fly around the false twist device.

* * * * *